US006533229B1

(12) United States Patent
Hung

(10) Patent No.: US 6,533,229 B1
(45) Date of Patent: Mar. 18, 2003

(54) ADJUSTABLE KEYBOARD TRAY FOR A DESK

(76) Inventor: Ray Hung, 11-2, Wu-Nan Rd., Wu-Chi Chen, Taichung Hsien (TW)

( * ) Notice: Subject to any disclaimer, the term of this patent is extended or adjusted under 35 U.S.C. 154(b) by 0 days.

(21) Appl. No.: 10/014,608

(22) Filed: Dec. 14, 2001

(51) Int. Cl.[7] ..... E04G 3/00

(52) U.S. Cl. ..... 248/286.1; 248/918; 248/276.1

(58) Field of Search ..... 248/286.1, 278.1, 248/283.1, 279.1, 118, 118.3, 918, 276.1, 284.1; 108/75, 93, 140, 138, 6, 141

(56) References Cited

U.S. PATENT DOCUMENTS 5,257,767 A * 11/1993 McConnell ..... 248/284.1
5,697,303 A * 12/1997 Allan ..... 108/93
5,924,666 A * 7/1999 Liu ..... 248/286.1
6,027,090 A * 2/2000 Liu ..... 248/281.11
6,116,557 A * 9/2000 Choy et al. ..... 248/286.1
6,135,404 A * 10/2000 Wisniewski et al. ... 248/281.11
6,186,460 B1 * 2/2001 Lin ..... 248/284.1
6,199,809 B1 * 3/2001 Hung ..... 248/284.1
6,270,047 B1 * 8/2001 Hudson ..... 248/286.1
6,279,859 B2 * 8/2001 West et al. ..... 248/118
6,409,127 B1 * 6/2002 VanderHeide et al. ..... 248/118
2002/0043601 A1 * 4/2002 Barber ..... 248/276.1

* cited by examiner

*Primary Examiner*—Leslie A. Braun
*Assistant Examiner*—A. Joseph Wujciak, III
(74) *Attorney, Agent, or Firm*—Fei-Fei Chao; Venable, Baetjer, Howard & Civiletti

(57) ABSTRACT

An adjustable keyboard tray is composed of a sliding base (10), a connecting arm (20), a limit link (25), a drive assembly (30), a keyboard support (40) and a locking device (50). The connecting arm (20) is pivotally attached to the sliding base (10) and the keyboard support (40) at two ends respectively, wherein the limit link (25) and the drive assembly (30) are movably pivoted on one end of the connecting arm (20). The locking device (50) directly controls the drive assembly (30) to release/compress the limit link (25) and then to unlock/lock the connecting arm (20) by rotating an eccentric cam (53). When the connecting arm (20) is unlocked, the angle and height of the keyboard support (40) are simultaneously adjustable.

12 Claims, 11 Drawing Sheets

ADJUSTABLE KEYBOARD TRAY FOR A DESK

BACKGROUND OF THE INVENTION

1. Field of the Invention

The present invention relates to an adjustable tray, and more particularly to an adjustable keyboard tray for a computer desk, which can be conveniently adjusted.

2. Description of Related Art

With reference to FIGS. 9–11, a conventional adjustable keyboard tray for a desk comprises a mounting bracket (80), a slide (81), a first adjusting arm (90), a second adjusting arm (82) and a keyboard plate (86). The mounting bracket (80) is adapted to be attached to the bottom of a desktop (70). The slide (81) is movably mounted on the mounting bracket (80). The first adjusting arm (90) and the second adjusting arm (82) are pivotally attached to opposite sides of the slide (81). The keyboard plate (86) is adjustably connected to the adjusting arms (90, 82).

With reference to FIGS. 9 and 10, the degree to which the keyboard plate (86) is inclined is adjusted by pivoting the keyboard plate (86) relative to the first and second adjusting arms (82, 90). The first and second adjusting arms (82, 90) are mirror images of each other, and the principle of operation is the same for both. The first adjusting arm (90) is composed of an upper rod **(90*a*) and a lower rod (90*b*). Both the upper and lower rods (90*a*, 90*b*) have two ends. One end of each rod (90*a*, 90*b*) is pivotally attached to the slide (81), and the other end is pivotally attached to a side plate (not numbered) of the keyboard plate (86). The lower rod (90*b*) is parallel to the upper rod (90*a*) and has one end pivotally attached on the slide (81). The other end of the lower rod (90*b*) is movably connected to the keyboard plate (86). A first curved slot (88) is defined in the side plate of the keyboard plate (86), and a first pin (92) formed on the lower rod (90*b*) sliding to the first curved slot (88). Therefore, when a user adjusts the angle of the keyboard plate (86), two first knobs (87, in FIG. 9) mounted on the first adjusting arm (90) and the second adjusting arm (82) respectively are rotated to release the first pin (92). Then, the first pin (92) moves along the first curved slot (88) to pivot the keyboard plate (86) around a pivot pin (91) on the upper rod (90*a*) to adjust the angle of the keyboard plate (86). When the keyboard plate (86) reaches a desired angle, the knobs (91) are tightened to lock the first pin (92) again to hold the keyboard plate (86) in position. Additionally, a second curved slot (89) is defined in the side plate of the keyboard plate (86), and a second pin (85) formed in a middle section of the lower rod (90*b*) is mounted in the second curved slot (89)**.

With reference to FIG. 11, The height of the keyboard plate (86) is adjusted by changing the position of the second pin (85) in the second curved slot (89). Two second knobs (93, in FIG. 9) are secured on the second adjusting arm (82) and the first adjusting arm (90) respectively to lock the second sliding pin (85). Therefore, when the second knobs (89) are loosened to release the second sliding pin (85), the second sliding pin (85) is able to slide in the second curved slot (89). Meanwhile, the upper rod **(82*a*) and the lower rod (82*b*) simultaneously pivotal on the slide (81) whereby the height of the keyboard plate (86)** is adjusted.

Two pairs of knobs (87, 93) must be loosened and tightened to adjust the angle and height of the conventional adjustable keyboard tray. Therefore, adjustment of the conventional adjustable keyboard tray requires at least two operational steps which makes adjusting the position of the keyboard tray troublesome.

To obviate and/or alleviate the problem with the conventional adjustable keyboard tray, the present invention provides an adjustable keyboard tray that requires only one operational step to adjust the height and angle of the keyboard tray.

SUMMARY OF THE INVENTION

The main objective of the invention is to provide an adjustable keyboard tray, which is easily adjusted.

Other advantages and novel features of the invention will become more apparent from the following detailed description when taken in conjunction with the accompanying drawings.

DETAILED DESCRIPTION OF THE PREFERRED EMBODIMENT

Figure 1:
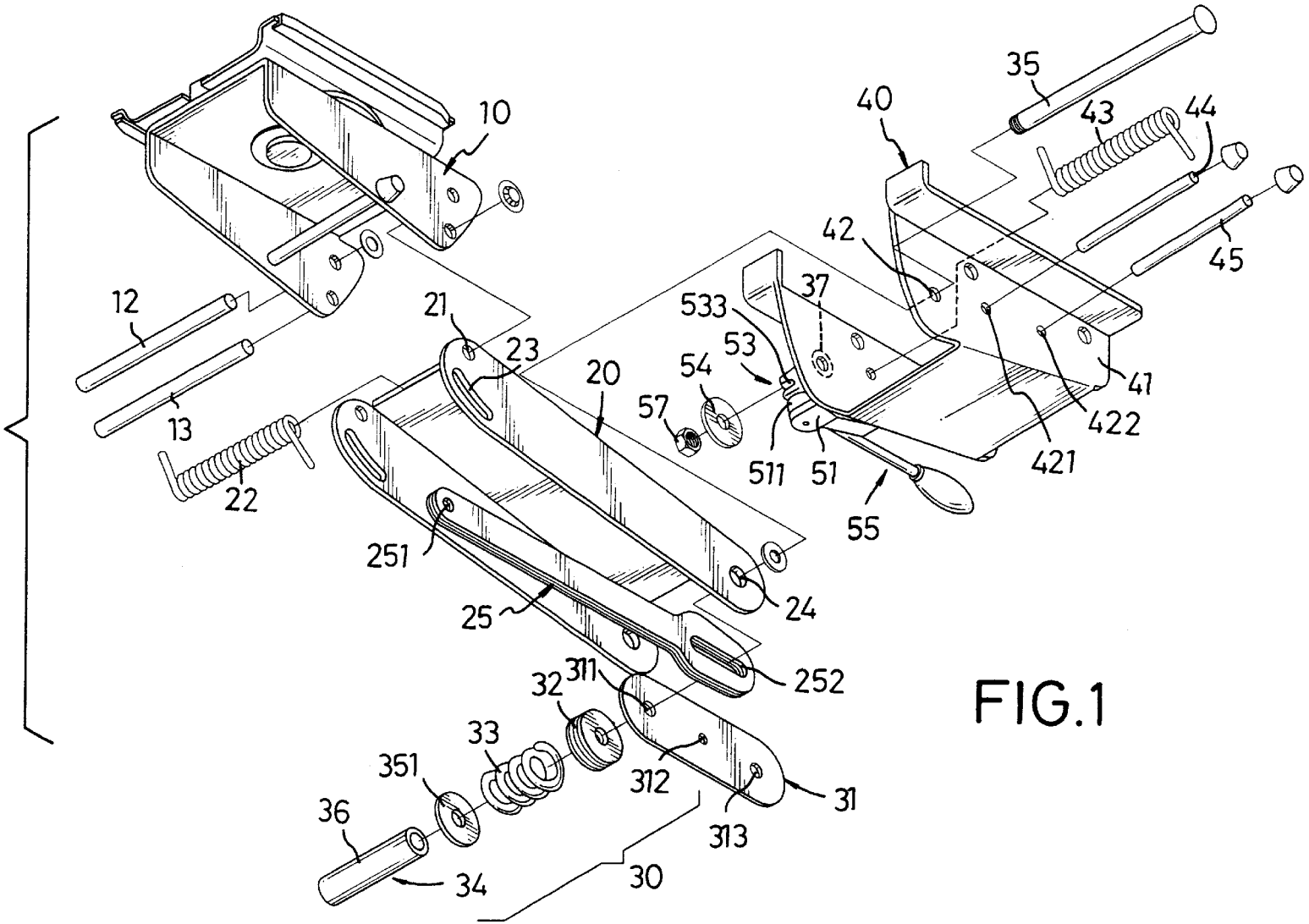
FIG. 1 is an exploded perspective view of an adjustable keyboard tray in accordance with the present invention.
Figure 2:
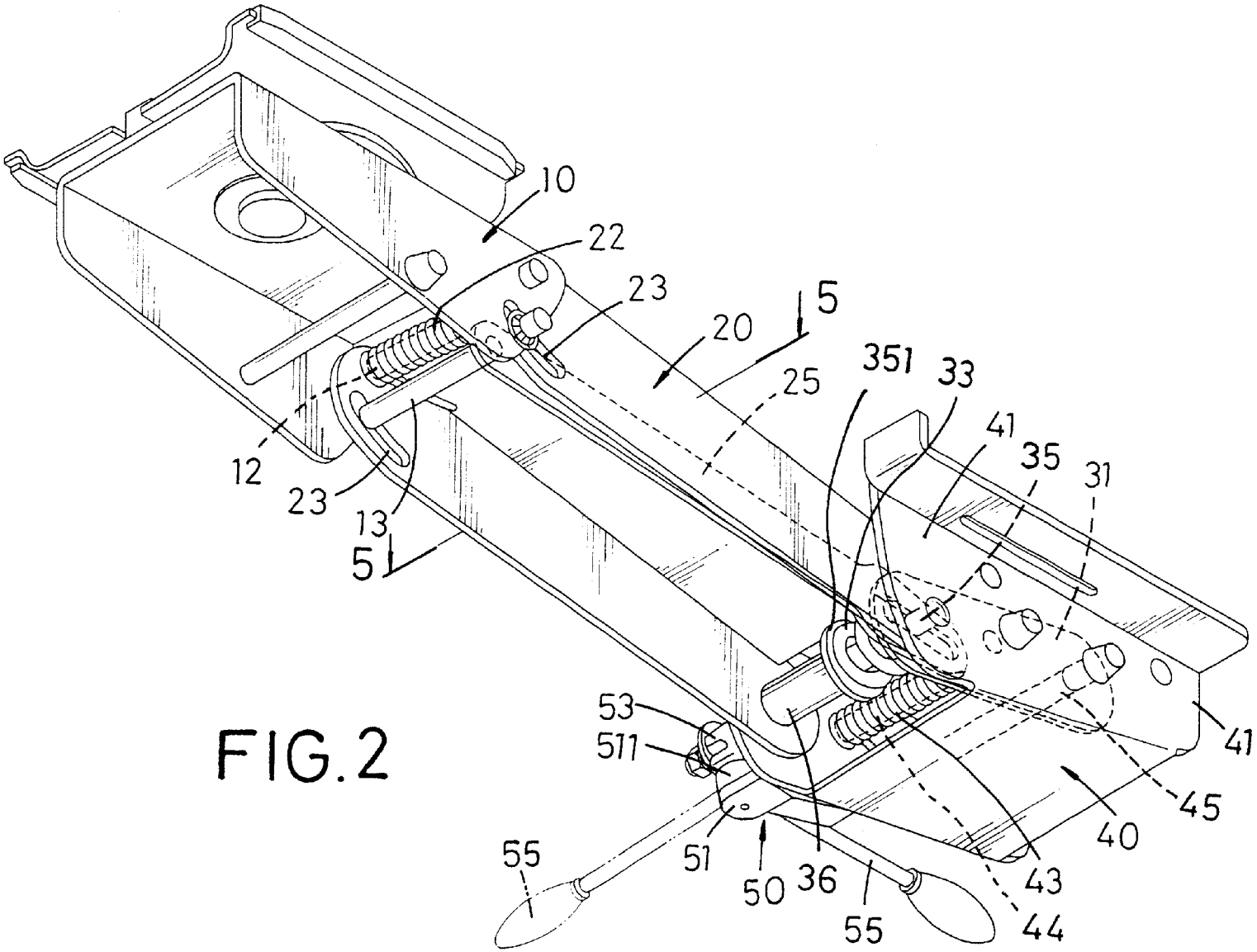
FIG. 2 is a perspective view of the adjustable keyboard tray in FIG. 1.

With reference to FIGS. 1 and 2, an adjustable keyboard tray in accordance with the present invention comprises a sliding base (10), a connecting arm (20), a limit link (25), a drive assembly (30), keyboard support (40), and a locking device (50).

The sliding base (10) adapts to movably attach under a computer desk and has two opposite side wings protruding downwardly. A first pivot rod (12) and a second pivot rod (13) are laterally secured between the two wings on end portions toward to the keyboard support (40).

The connecting arm (20) is substantially an inverted U-shape and has a first end pivotally connected to the sliding base (10) and a second end pivotally connected to the keyboard support (40). Two first through holes (21) are defined in opposite sides of the first end so a first pivot rod (12) attached to the sliding base (10) penetrate the first through holes (21) to attach the connecting arm (20). An arcuate groove (23) is laterally defined in each side of the connecting arm (20) near the through holes (21) and movably receives a second pivot rod (13) attached to the sliding base (10). The second pivot rod (13) adds additional pivotal stability, and the arcuate grooves (23) allows the connecting arm (20) to pivot relative to the sliding base (10). A second through hole (24) is defined in each side of the second end of the connecting arm (20) to attach the connecting arm (20) to the keyboard support (40).

The limit link (25) is a long strip composed of multiple lamina and is movably mounted adjacent to one side of the connecting arm (20). A pivot hole (251) is defined in on end of the limit link (25) to correspond to the arcuate grooves (23) in the connecting arm (20), and the second pivot rod (13) penetrates the pivot hole (251) and the arcuate grooves (23). Therefore, the second pivot rod (1 3) is pivotally attaches the connecting arm (20) to the sliding base (10). An elongated hole (252) is defined in the other end of the limit link (25) to correspond to the second through holes (24) in the connecting arm (20). Additionally, a first coil spring (22) is mounted around the first pivot rod (12) between the sides of the connecting arm (25). The first coil spring (22) has a first end firmly secured on an inner side face of the connecting arm (20) and a second end firmly abutting the sliding base (10) to provide a restitution force to the connecting arm (20).

The drive assembly (30) is controlled by the locking device (50) and is partially retained between the second end of the limit link (25) and the opposite side of the connecting arm (20). The drive assembly (30) is composed of a guide plate (31), a multi-layered resilient washer (32), a resilient element (33), and a control shaft (34). The control shaft (34) further is composed of an inner shaft (35) and an outer sleeve (36). The guide plate (31) is mounted next to the limit link (25) and partially overlaps the limit link (25) and has a first aperture (311), a second aperture (312) and a third aperture (313) defined in the guide plate (31) in a line. The multi-layered resilient washer (32), the resilient element (33) and the outer sleeve (36) are mounted in sequence around the inner shaft (35) after the guide plate (31). Additionally, two washers (a first washer (351) and a second washer (37)) are mounted respectively at distal ends of the outer sleeve (36) to prevent damage due to friction during operation.

The keyboard support (40) is also U-shaped, has two side wings (41), attaches to the second end of the connecting arm (20) and has the drive assembly (30) mounted inside. Each side wing (41) is close to the corresponding side of the connecting arm (20) and has a first hole (42), a second hole (421) and a third hole (422) defined to respectively correspond to the three apertures (311, 312, 313) in the guide plate (31). A middle mounting pin (44) and a side mounting pin (45) extend between the side wings (41) and respectively secured on the keyboard support (40) via the second hole (421) and the third hole (422). A second coil spring (43) is mounted around the middle mounting pin (44) and has a first end abutting the multi-layered resilient washer (32) and a second end abutting the side mounting pin (45) thereby providing a restitution force to the keyboard support (40).

Figure 3:
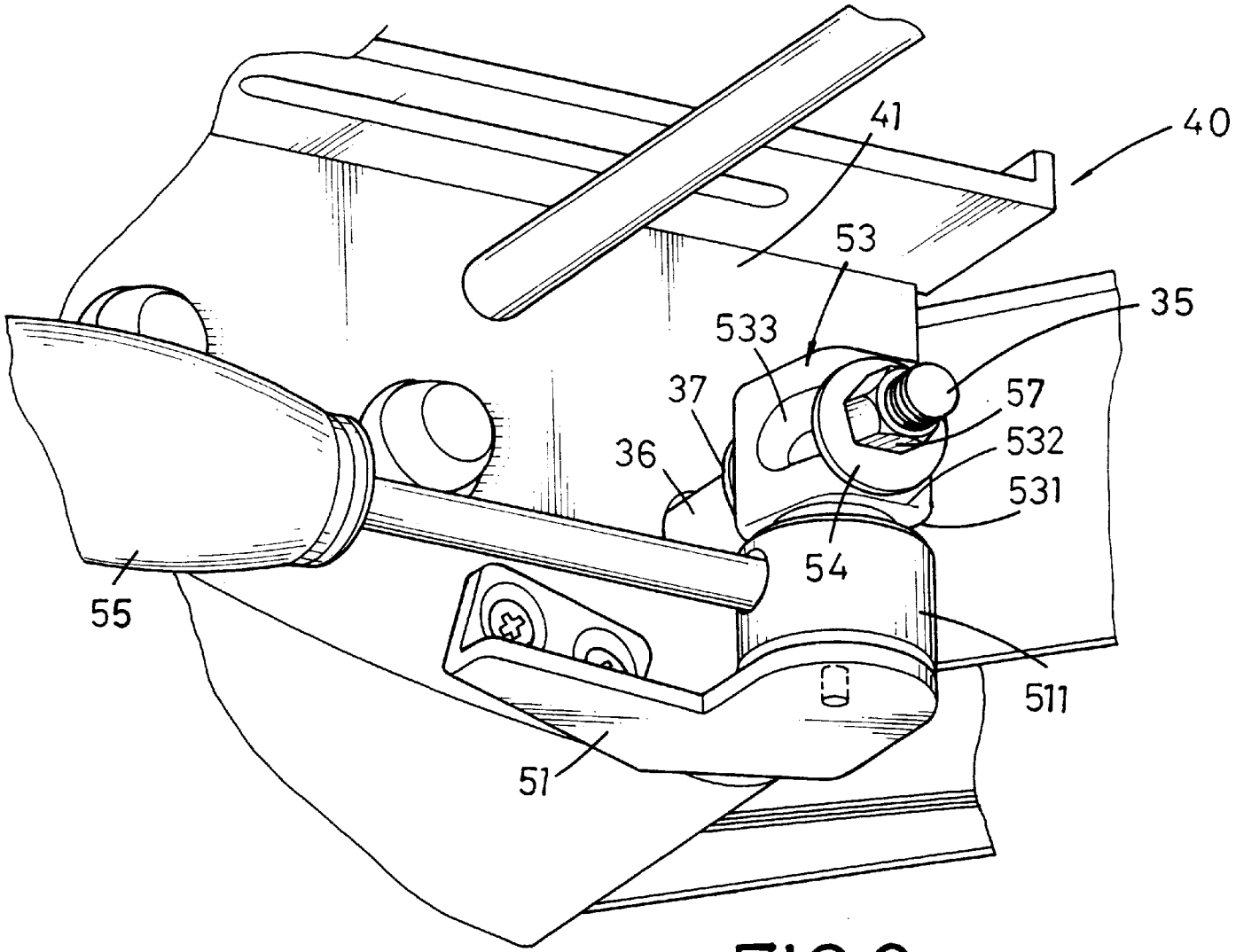
FIG. 3 is an enlarged view of a locking device of the adjustable keyboard tray in FIG. 2.
Figure 4:
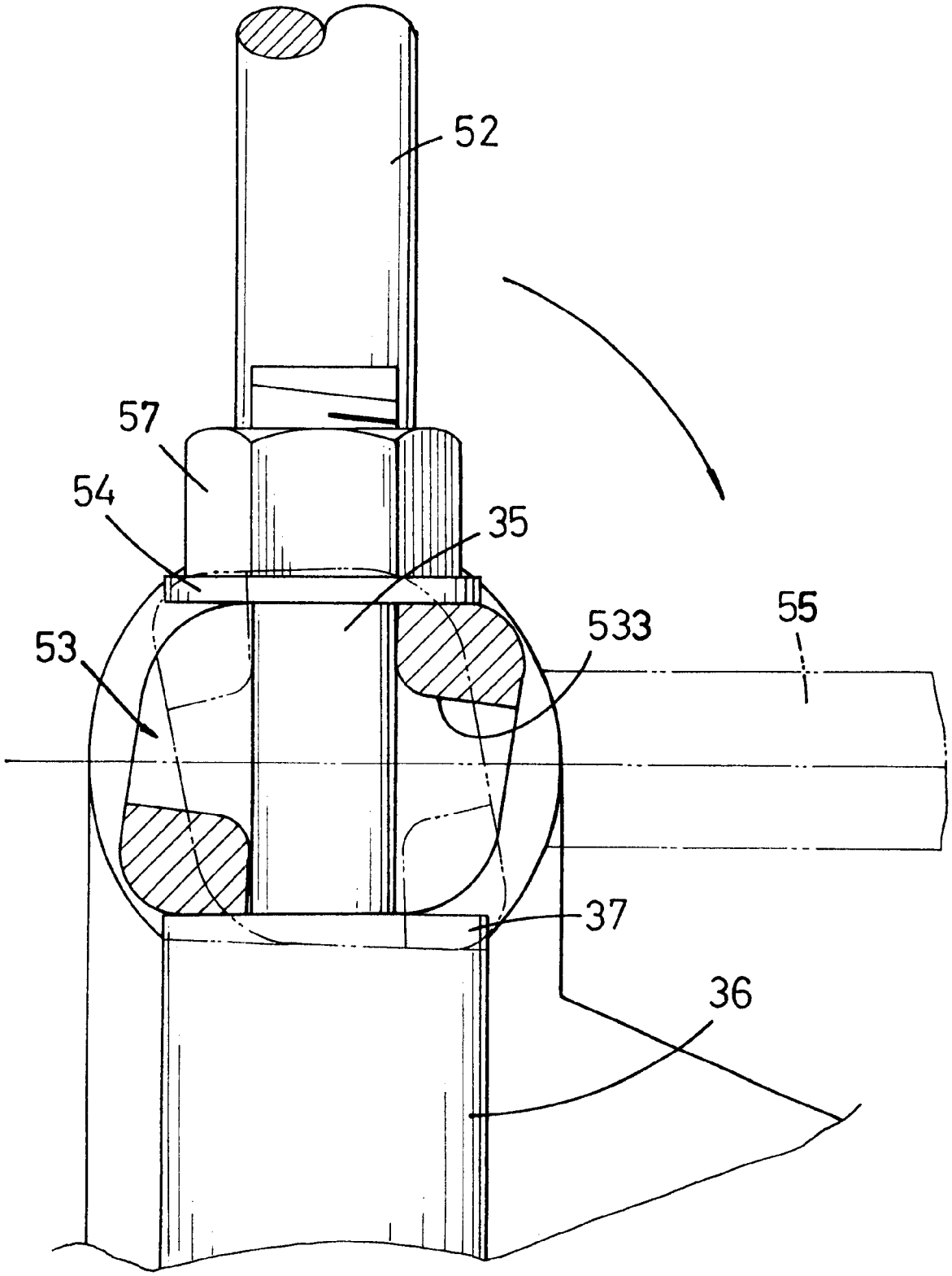
FIG. 4 is an enlarged operational cross sectional top plan side view of an eccentric cam of the locking device in FIG. 2.

With reference to FIGS. 2 and 3, the locking device (50) is composed of a bracket (51), an eccentric cam (53) and a lever (55). The bracket (51) is attached to the side wing (41) of the keyboard support (40) and has a post (511) rotatably mounted on the bracket (51). The eccentric cam (53) is securely attached the post (511 ) and penetrated by the inner shaft (35) of the drive assembly (30). The inner shaft (35) has one end attached to the keyboard support (40) and the other end movably connected to the eccentric cam (53). A nut (57) is screwed on the second end of the inner shaft (35) to keep the eccentric cam (53) pressed against the outer sleeve (36). A washer (54) is mounted around the inner shaft (35) between the nut (57) and the eccentric cam (53) to prevent wear due to mechanical friction. The eccentric cam (53) is a substantially parallelogram composed of two opposite long sides (531) and two opposite short sides (532). The lever (55) is firmly attached to the post (511) to rotate the eccentric cam (53) with the post (511). Additionally, two widened slots (533) are symmetrically defined in the eccentric cam (53) a quarter way around the second end of the inner shaft (35) to allow the inner shaft (35) to move inside the slots (533) without obstruction as shown in FIG. 4.

Figure 5:
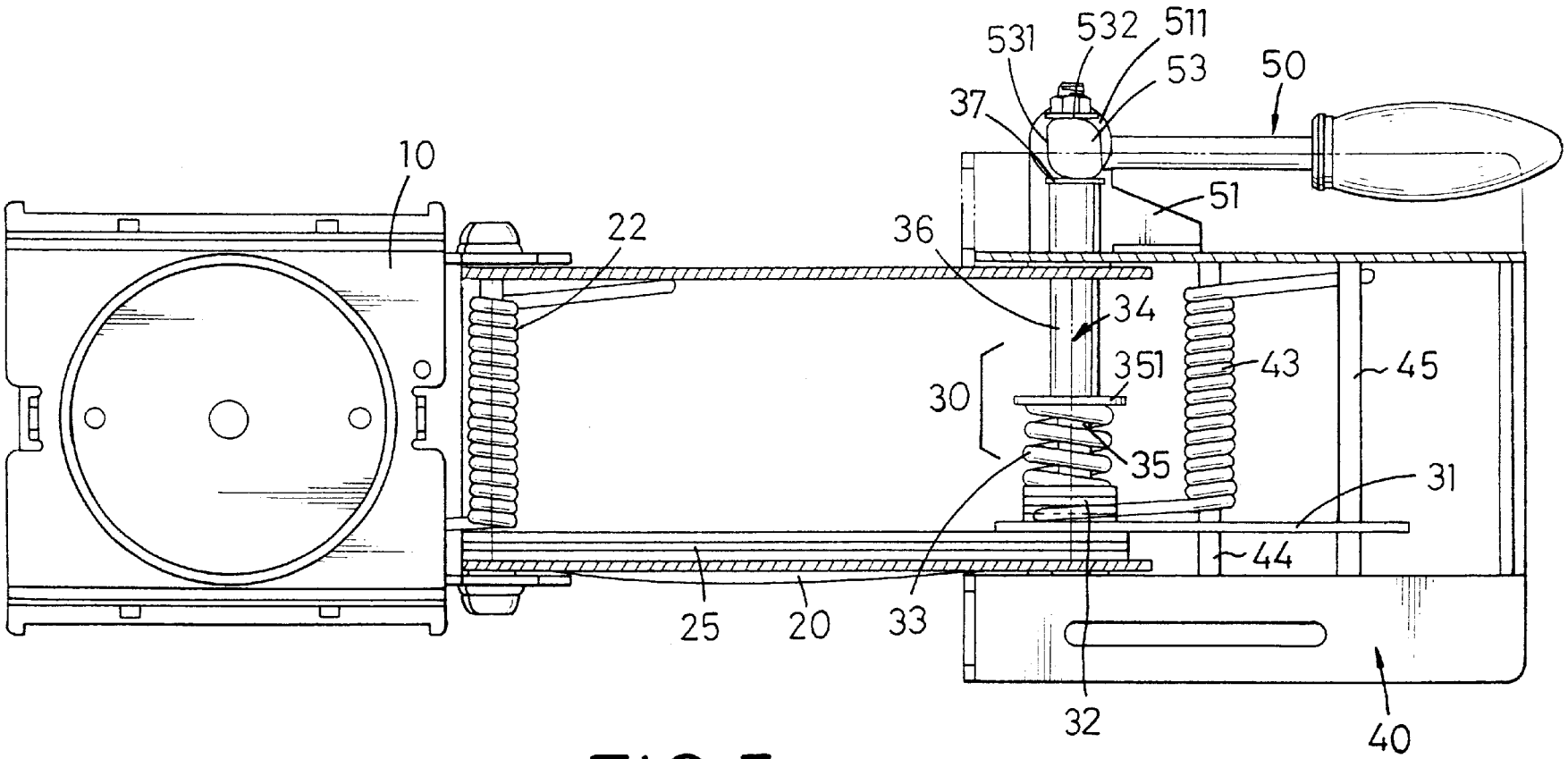
FIG. 5 is a cross sectional top plan view of the adjustable keyboard tray along with a line 5—5 in FIG. 2, when the adjustable keyboard tray is locked.

Further with reference to FIG. 5, when the locking device (50) is in a locked position, the eccentric cam (53) is situated in a position with the long sides (531) extending in line with the inner shaft (35). In this position, the outer sleeve (36) squeezes the drive assembly (30), and the drive assembly (30) squeezes the limit link (25) against the connecting arm (20). The connecting arm (20) is held in place and cannot be moved.

Figure 6:
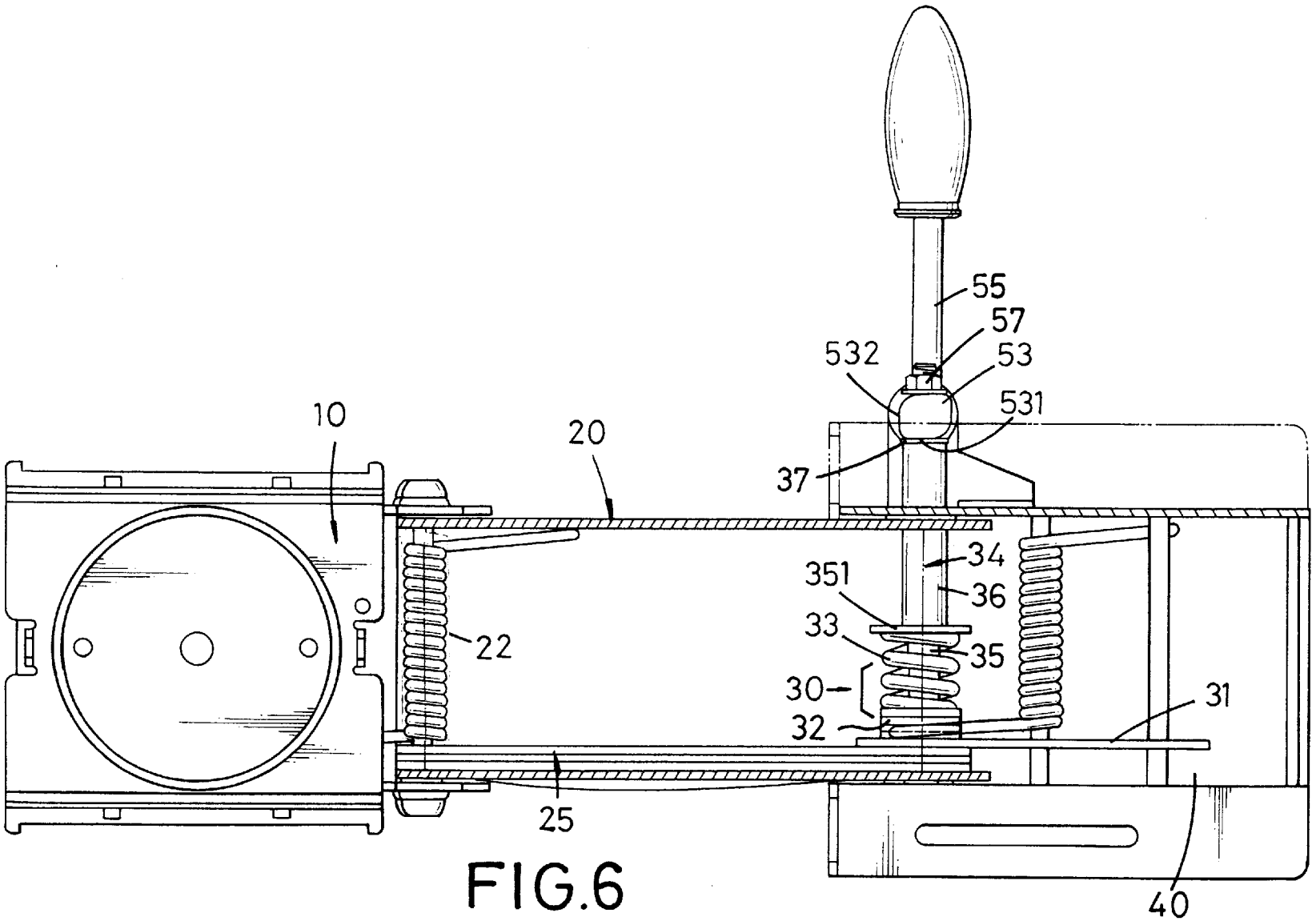
FIG. 6 is a cross sectional top plan view of the adjustable keyboard tray in FIG. 5, when the adjustable keyboard tray is unlocked.

With reference to FIG. 6, when the locking device (50) is in an unlocked position, the lever (55) is rotated 90° outward so the eccentric cam (53) is also rotated 90°. With the eccentric cam (53) rotated 90°, the short sides (532) extend along the axial direction of the inner shaft (35) and release the outer sleeve (36) from pressing against the drive assembly (30). Therefore, the limit link (25) is not squeezed against the connecting arm (20) and the adjustable keyboard tray is movable at two pivotal ends of the connecting arm (20) to adjust the angle and height of the keyboard tray (40).

Figure 7:
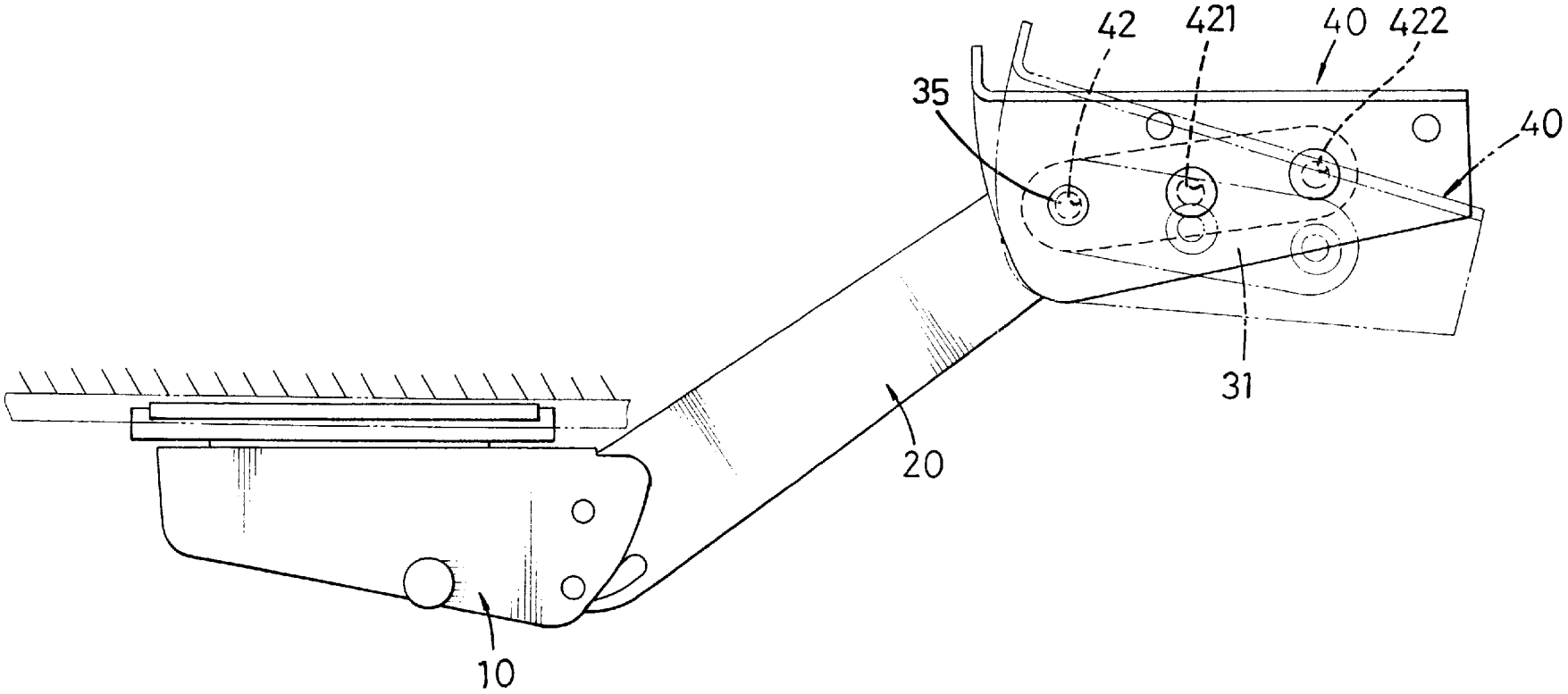
FIG. 7 is an operational side plan view of the adjustable keyboard tray in FIG. 2 showing the angular adjustment of the keyboard plate.
Figure 8:
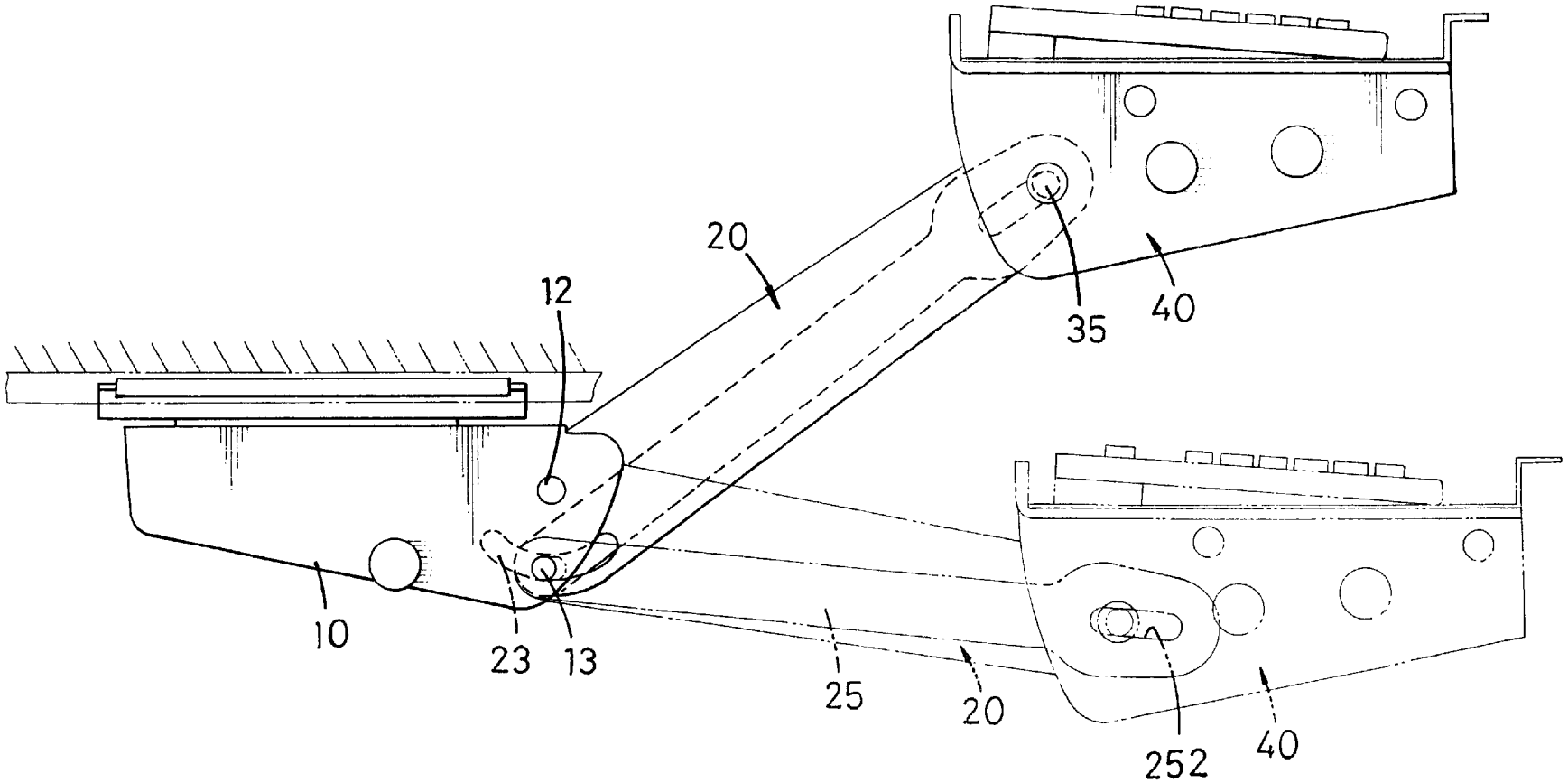
FIG. 8 is an operational side plan view of the adjustable keyboard tray in FIG. 2 showing the height adjustment of the keyboard plate.
Figure 9:
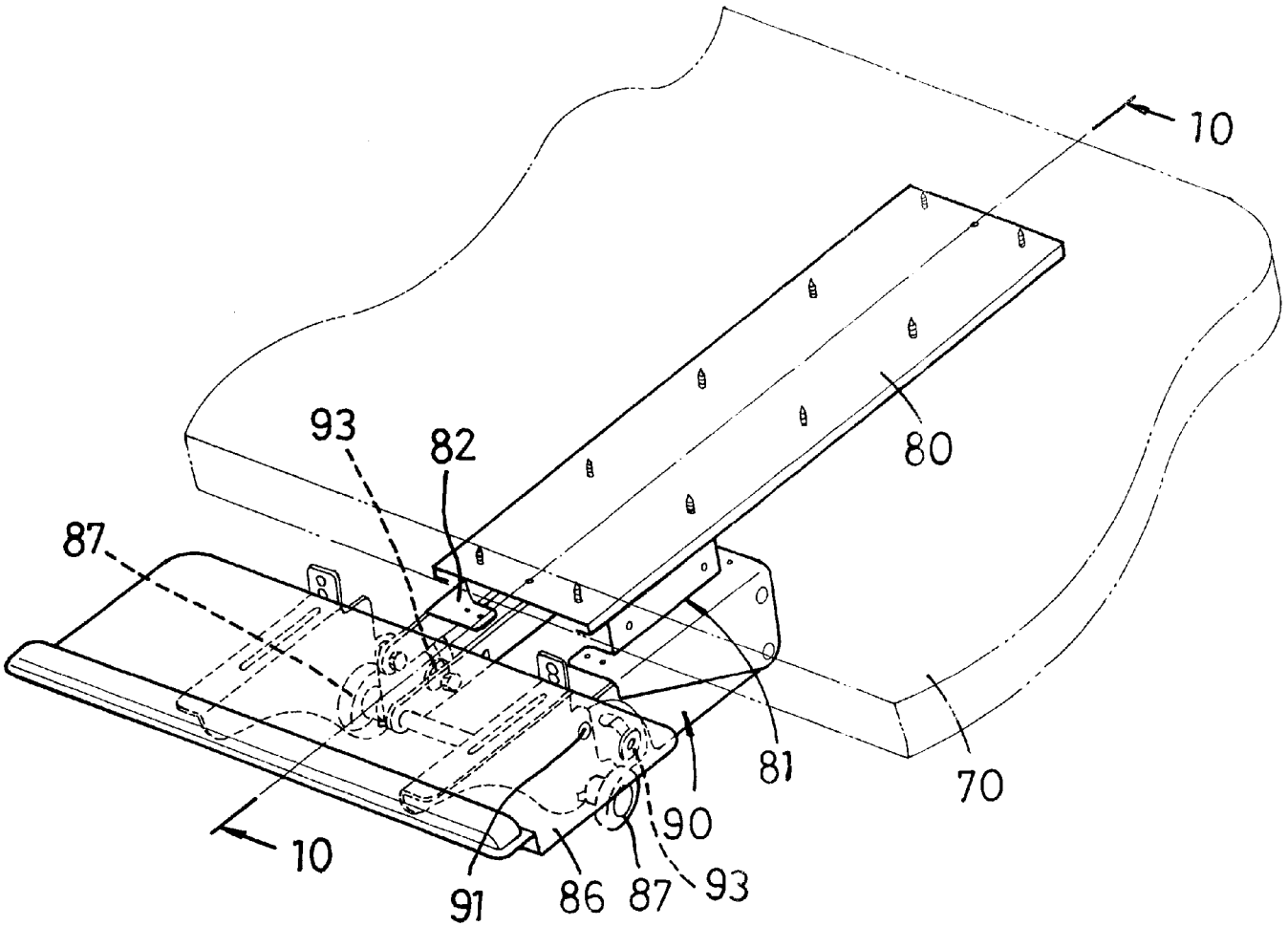
FIG. 9 PRIOR ART
FIG. 9 is a perspective view of a conventional adjustable keyboard tray in accordance with the prior art.
Figure 10:
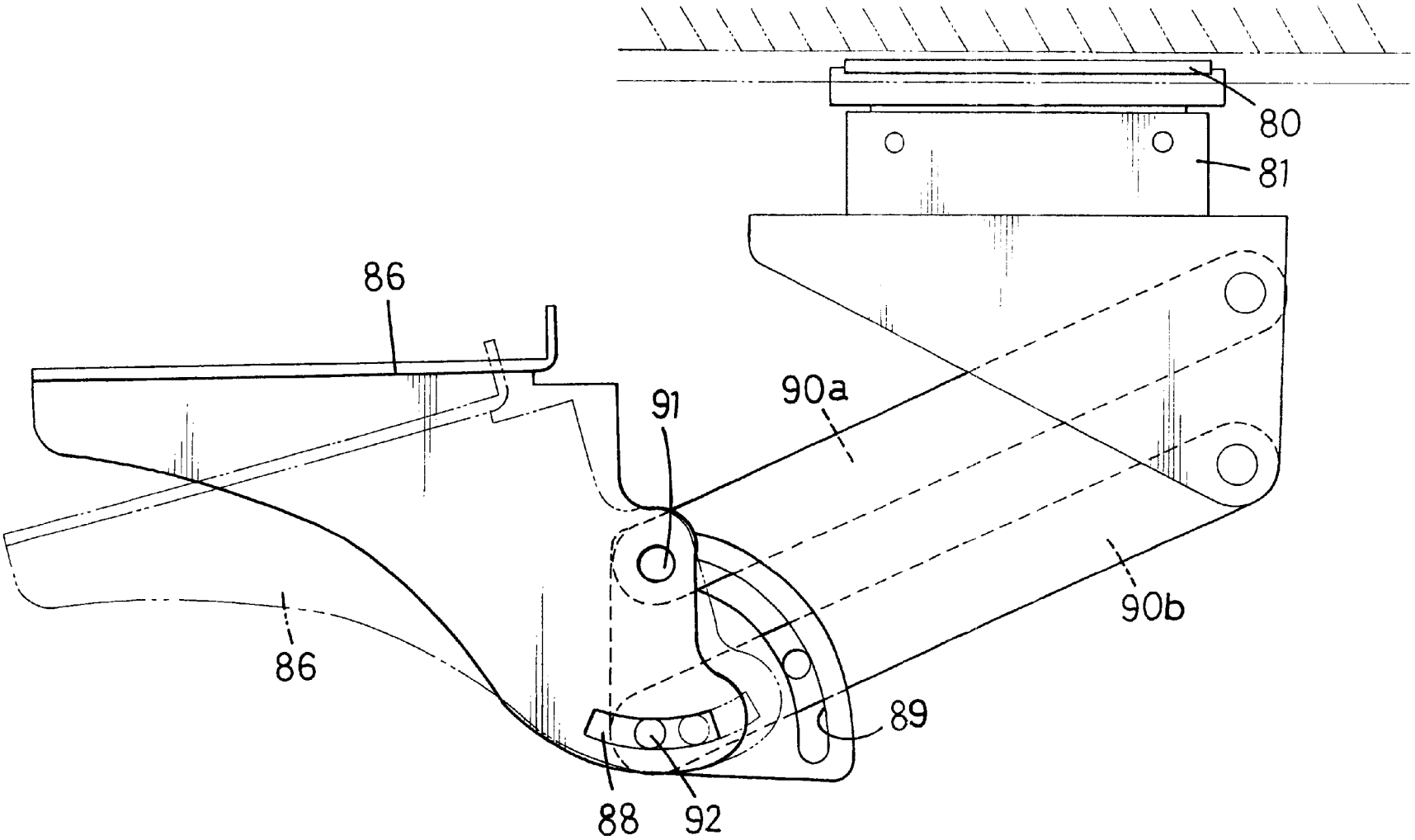
FIG.10 PRIOR ART
FIG. 10 is an operational side plan view of the conventional adjustable keyboard tray in FIG. 2 showing the angular adjustment of the keyboard plate.
Figure 11:
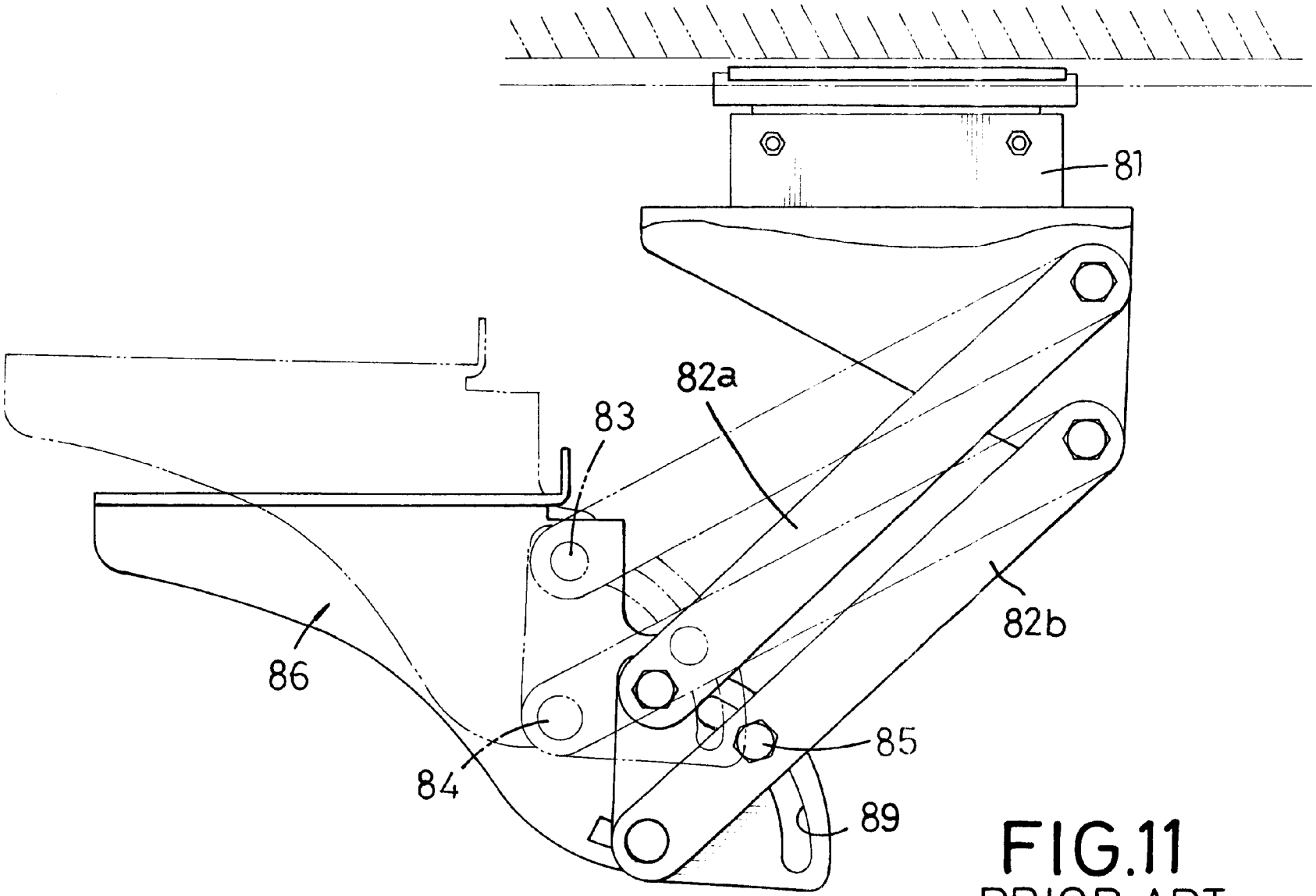
FIG.11 PRIOR ART
FIG. 11 is an operational cross sectional side plan view of the conventional adjustable keyboard tray in FIG. 9 showing the height adjustment of the keyboard plate.

With reference to FIG. 7, when a user wants to adjust the angle of the keyboard support (40), the keyboard support (40) is rotated to a desired angle using the inner shaft (35) as a pivot. With reference to FIG. 8, when the user wants to adjust the height of the keyboard tray (40), the connecting arm (20) is adjusted and pivots on the sliding base (10) using the first pivot rod (12) as a pivot. The inner shaft (35) simultaneously moves in the elongated hole (252) in the limit link (25) to maintain the angle of the keyboard support (40). When the height and the angle of the keyboard support (40) are proper, the lever (55) is rotated back to the locked position to hold the adjustable keyboard tray in the desired position.

As demonstrated in the foregoing description, the operation of the adjustable keyboard tray in accordance with the present invention is simplified. Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An adjustable keyboard tray adapted for use with a computer desk having a computer desktop, and the keyboard tray comprising:

a sliding base (10) adapted to movably attach to a bottom of the computer desktop and having two opposite side wings, a first pivot rod (12) and a second pivot rod (13) extending between the opposite side wings;

an U-shaped connecting arm (20) pivotally connected to the sliding base (10) at a first end and having a first through holes (21) defined in each side of the connecting arm (20) to pivotally attach the first pivot rod (12) to the sliding base (10);

a arcuate groove (23) defined near each through hole (21) and movably receiving the second pivot rod (13) of the sliding base (10) to allow the connecting arm (20) to pivot with the sliding base (10); and a second through hole (24) defined in each side of a second end of the connecting arm (20);

a limit link (25) moveably mounted adjacent to one side of the connecting arm (20) and having a pivot hole (251) defined in one end of the limit link (25) to correspond to the arcuate grooves (23) in the connecting arm (20); and an elongated hole (252) defined in the other end to correspond to the second through holes (24) in the connecting arm (20);

a drive assembly (30) mounted adjacent to the limit link (25) to squeeze and hold the limit link (25) to selectively control the position of the connecting arm (20), the drive assembly (30) comprising a guide plate (31) mounted next to the limit link (25) and partially overlapping the limit link (25);

a resilient element (33) mounted next to the guide plate (31) to push the guide plate (31) to abut against the limit link (25); and a control shaft (34) penetrating the guide plate (31) and the resilient element (33);

a U-shaped keyboard support (40) adapted to support a keyboard and pivotally connect to the second end of the connecting arm (20) and the drive assembly (30) by the control shaft (34), the keyboard support (40) having a middle mounting pin (44) and a side mounting pin (45) extending between side wings of the keyboard support (40), both mounting pins (44, 45) penetrating the guide plate (31) respectively; and a locking device (50) connected to the control shaft (34) and controlling the drive assembly (30) to press the limit link (25) to lock/unlock the connecting arm (20).

2. The adjustable keyboard tray as claimed in claim 1, wherein the locking device (50) comprises:

a bracket (51) attached to the keyboard support (40);

a post (511 ) rotatably mounted on the bracket (51);

an eccentric cam (53) securely attached to the post (511) and penetrated by the control shaft (34) of the drive assembly (30), wherein the eccentric cam (53) has two widened slots (533) symmetrically defined in the eccentric cam (53) a quarter way around the control shaft (34) to allow the control shaft (35) to move inside the slots (533) without obstruction; and a lever (55) firmly attached to the post (51 1) to rotate the eccentric cam (53) with the post (511) to control the drive assembly (30) locking/unlocking the connecting arm (20).

3. The adjustable keyboard tray as claimed in claim 2, wherein the control shaft (34) comprises an inner shaft (35) and an outer sleeve (36);

wherein the inner shaft (35) penetrates the keyboard support (40), the guide plate (31), the resilient element (33), the outer sleeve (36) and the connecting arm (20) so as to pivotally connect the connecting arm (20) and the drive assembly (30) to the keyboard support (40), and the locking device (50) is connected to one end of the inner shaft (35);

the outer sleeve (36) has one end adjacent to the resilient element (33) and the other end adjacent to the eccentric cam (53) so that when the eccentric cam (53) rotates, the outer sleeve (36) enables to press the resilient element (33) and limit link (25) to lock the connecting base (20).

4. The adjustable keyboard tray as claimed in claim 3, wherein the drive assembly (30) further has:

a multi-layered resilient washer (32) sandwiched between the guide plate (31) and the resilient element (33);

a first washer (351) mounted between the resilient element (33) and outer sleeve (36); and a second washer (37) mounted between the outer sleeve (36) and the locking device (50) to prevent mechanically frictional damage.

5. The adjustable keyboard tray as claimed in claim 4, wherein the first pivot rod (12) further has a first coil spring (22) mounted around the first pivot rod (12);

wherein the first coil spring (22) has a first end firmly attached to the connecting arm (20) and a second end firmly abutting sliding base (10) to provide a restitution force to the connecting arm (20).

6. The adjustable keyboard tray as claimed in claim 5, wherein a second coil spring (43) is mounted around the middle mounting pin (44);

wherein the second recoiling spring (43) has a first end abutting the multi-layered resilient washer (32) and a second end abutting the side mounting pin (45) whereby providing recoiling force to the keyboard support (40).

7. The adjustable keyboard tray as claimed in claims 6, wherein the eccentric cam (53) is a substantially parallelogram composed of two opposite long sides (531) and two opposite short sides (532).

8. The adjustable keyboard tray as claimed in claim 4, wherein a second coil spring (43) is mounted around the middle mounting pin (44);

wherein the second coil spring (43) has a first end abutting the multi-layered resilient washer (32) and a second end abutting the side mounting pin (45) thereby providing a restitution force to the keyboard support (40).

9. The adjustable keyboard tray as claimed in claim 2, wherein the eccentric cam (53) is a substantially parallelogram composed of two opposite long sides (531) and two opposite short sides (532).

10. The adjustable keyboard tray as claimed in claim 1, wherein the drive assembly (30) further has:

a multi-layered resilient washer (32) mounted between the guide plate (31) and one side of the resilient element (33);

a first washer (351) mounted adjacent to the other side of the resilient element (33) to prevent wear of the resilient element (33) to the control shaft (34); and a second washer (37) mounted adjacent to the locking device (50) to prevent mechanically frictional damage of the locking device (50) to the control shaft (34).

11. The adjustable keyboard tray as claimed in claim 10, wherein a second coil spring (43) is mounted around the middle mounting pin (44);

wherein the second coil spring (43) has a first end abutting the multi-layered resilient washer (32) and a second end abutting the side mounting pin (45) thereby providing a restitution force to the keyboard support (40).

12. The adjustable keyboard tray as claimed in claim 1, wherein the first pivot rod (12) further has a first coil spring (22) mounted around the first pivot rod (12);

wherein the first coil spring (22) has a first end firmly attached to the connecting arm (20) and a second end firmly abutting sliding base (10) to provide a restitution force to the connecting arm (20).

* * * * *